United States Patent [19]

Nist

[11] 4,136,988

[45] Jan. 30, 1979

[54] ROUND-NOSE FRAME JOINT

[75] Inventor: Eugene M. Nist, Tacoma, Wash.

[73] Assignee: Seattle Box Co., South Kent, Wash.

[21] Appl. No.: 738,477

[22] Filed: Nov. 3, 1976

[51] Int. Cl.[2] ..... B25G 3/00; F16B 7/00

[52] U.S. Cl. ..... 403/231; 5/264 B; 403/

[58] Field of Search ..... 403/231, 388, 393, 382, 403/403, 230; 52/656, 657, 589, 592; 5/293, 297, 264 B; 160/381

[56] References Cited

U.S. PATENT DOCUMENTS

| | | | |
|---|---|---|---|
| 1,161,169 | 11/1915 | Van Fleet et al. | 160/381 X |
| 1,763,837 | 6/1930 | Vernet | 52/656 X |
| 3,080,576 | 3/1963 | Cervisi | 5/264 |

*Primary Examiner*—Wayne L. Shedd

*Attorney, Agent, or Firm*—Ford E. Smith

[57] ABSTRACT

A round-nosed frame joint for the corners of wooden structures useful, for example, in bedding furniture is disclosed to comprise a pair of wooden members securely joined together at right angles to each other in such manner that a machined nosing to round the joint is restricted to the confines of a single member of the two-part joint.

2 Claims, 9 Drawing Figures

Fig. 1
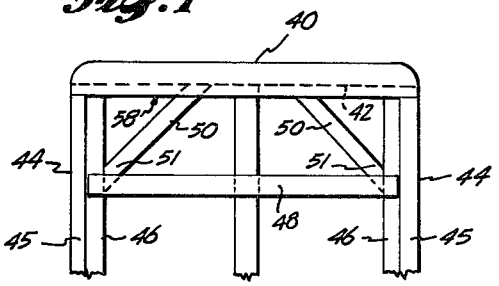
Fig. 3.
(PRIOR ART)
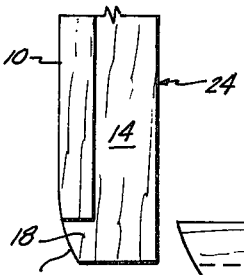
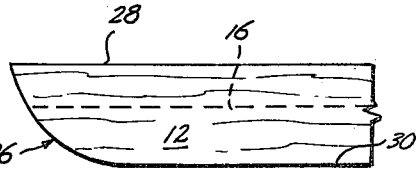
Fig. 4.
(PRIOR ART)
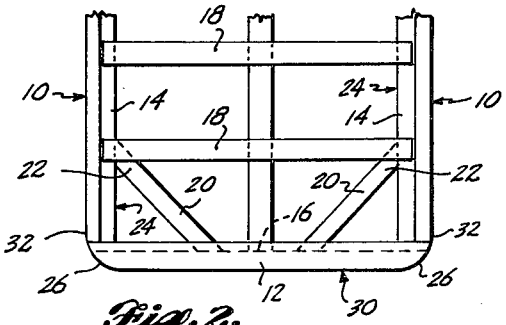
Fig. 2.
(PRIOR ART)
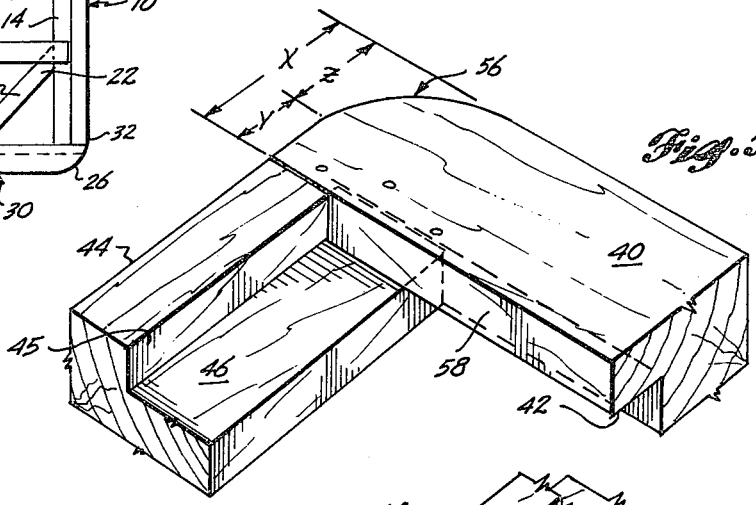
Fig. 5.
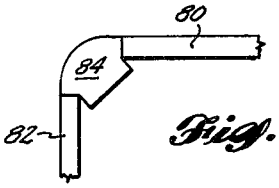
Fig. 9.
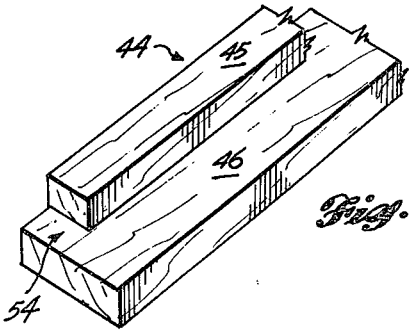
Fig. 6.
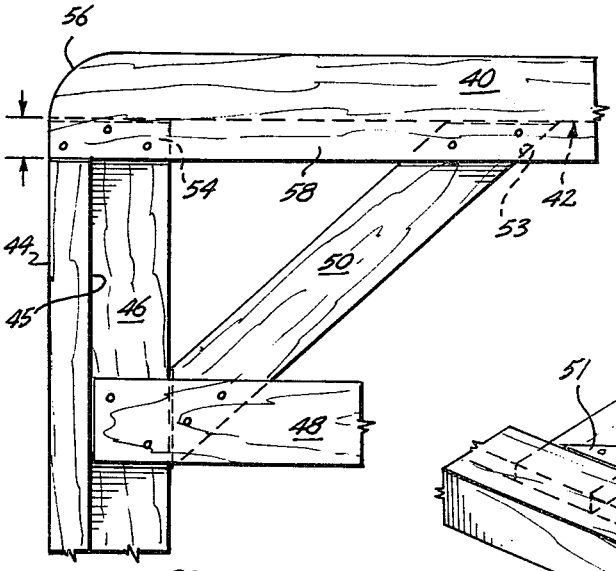
Fig. 7.
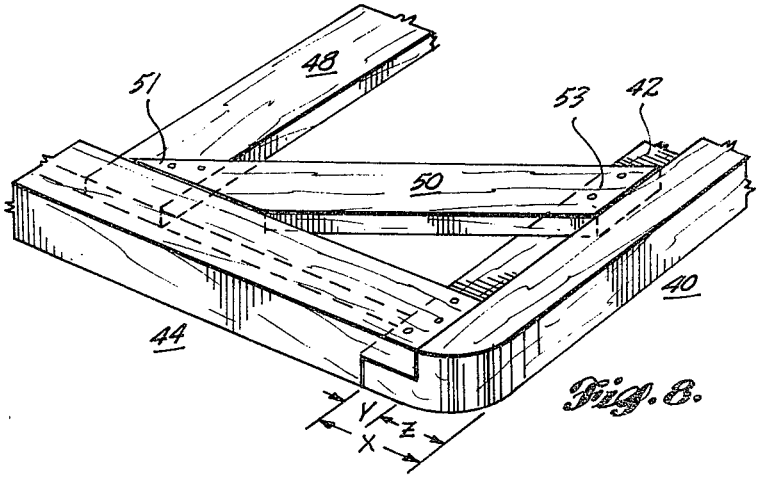
Fig. 8.

ROUND-NOSE FRAME JOINT

SUMMARY OF THE INVENTION

A wooden frame for use in the manufacture of bedding furniture, such as box spring structures and the like, usually comprises four structural members joined at right angles desirably provided with round noses at each corner of the structure. Each corner comprises a first elongated member of wood having a non-rabbetted and a parallel inside edge rabbetted portion extending longitudinally throughout the length of the member. The depth of the rabbet, i.e., the thickness of the wooden portion remaining after rabbetting, is substantially one-half the thickness of said elongated first member. Each end of said first elongated member is arcuately rounded, the curvature of which is restricted to between the outer edge of said non-rabbetted portion and the end of the non-rabbetted portion, merging approximately tangential with the end of the flange of said first member. A second elongated member of a thickness equal to the first member has a transverse or lateral rabbet at its end which interfits with the rabbet of the first member, merging tangentially at its outer edge with the rounded end thereof. The second member is also rabbetted linearly along its inside edge in a manner opposite the rabbetting of the first member. Both members are firmly and securely fixed together in their interfitted relationship by appropriate and conventional fastening means.

Among the important objects of this invention is to provide a simple and effective mode of manufacturing wooden members for interfitting relationship in the formation of a round-nosed corner joint for the manufacture of wooden frames and including the elimination of heretofore-considered manual and machining operations undesirably affecting the economics of such manufacture. These and other objects will become more apparent during the course of the following description in which is set forth a detailed disclosure of certain prior art practices against which is contrasted the features of the invention herein.

DESCRIPTION OF THE DRAWINGS

FIG. 1 is a top face view of an end portion of a typical wooden frame embodying this invention;

FIG. 2 is a top face view of a similar end portion of a frame according to the prior art;

FIGS. 3 and 4 show the two parts of a round-nosed, rabbetted frame joint according to the prior art;

FIG. 5 is a perspective view of the top side of a frame joint corner showing the rabbetted joint of this invention;

FIG. 6 is a perspective view of an end of a side rail employed in the rabbetted joint of this invention;

FIGS. 7 and 8 are respectively top side plan and bottom side perspective views of a round-nose corner of the frame shown in FIG. 1; and FIG. 9 illustrates another prior art round-nose frame joint.

DESCRIPTION OF PRIOR PRACTICES

It is believed that for one to properly comprehend the invention herein, an understanding of prior practices is necessary. For this reason, in FIGS. 2, 3 and 4 there is shown details of one type of round-nosed, rabbetted frame joint as heretofore manufactured for use in the bedding furniture industry. Such round-nosed frames are manufactured to comprise, for example, the base of a box spring assembly commonly used under mattresses according to current practices. Such prior frames employ a pair of side rails 10, 10 and an end or head rail 12. Each of the side rails have linear rabbets or notches 14 extending along their inner edges and disposed on their upper side. The end or head rail 12 also has a rabbet 16 on its under side. The ends of each of the side rails have transverse rabbets 18 that interfit with linear rabbet 16 of head rail 12, as best seen in FIG. 2. Spaced-apart cross slats 18, 18 have their ends disposed in rabbets 14 where they are secured by nails or staples. The interfitted parts 10 and 12 at the corners are also securely nailed. A diagonal corner brace 20 at each frame corner has one end disposed and secured in rabbet 16 of the end or head rail 12. Usually they are cut to fit at a 45° angle. The other end 22 of a brace 20 abuts the side rail 10 along the non-rabbetted edge 24 beneath the end of one of the cross slats 18, as shown in FIG. 2. The braces are also secured in place by nails or other suitable fastenings.

It is highly desirable that such frames at their corners be rounded in the previously practiced manner shown in FIG. 2. Heretofore manufacturers have provided the ends of the head rails 12 with an arcuate cut 26 that intersects the inner edge 28 and extends to approximate tangential relationship with the outer edge 30. Because of the particular overlapping relationship when the rabbets 16 and 18 are interfitted as described, it is then necessary to also arcuately curve or cut the outer edge of the side rail end at 32 to eliminate any protuberance of the end of the side rail at the round-nosed joint.

It should be borne in mind that the parts for frames as shown here are usually manufactured in a woodworking shop and shipped to the bedding furniture manufacturer in knocked-down condition where the parts are assembled in suitable positioning and clamping machinery. In the production of parts such as shown in FIGS. 3 and 4, in addition to the linear or transverse rabbetting, all of which is readily accomplished in a very conventional manner in the woodworking shop, it is also necessary to individually curve the ends at 26 and 32. To do this normally requires that a worker pick up each piece and apply it to a shaper or other power tool to make the arcuate cuts that are required. Thus, for a frame according to the prior art construction, there are four manual operations for each pair of side rails. Despite the exercise of a high degree of care and skill on the part of the worker, because of the necessarily smooth interfit to produce the desired round nose, it often occurs that the interfit is rough and the curves 26 and 32 are quite frequently mismatched and do not present the desired smoothness requisite for a good bedding furniture operation.

The alternate prior art joint of FIG. 9 comprises end rail 80 and side rail 82, usually 1 × 4 or 1 × 5 boards on edge, interfitted by means of round-nose corner block 84. The latter must be machined from timbers rarely available today, causing much waste of the raw wood members and costing much in labor and machining.

DETAILED DESCRIPTION OF THE INVENTION

Having the foregoing in mind, the reader's attention is now directed to the disclosure of the invention in FIGS. 1, 5, 6, 7 and 8. A frame according to this invention has the conventional end or head rail 40 provided with the internal linear rabbet 42; side rails 44, 44 each having linear rabbets 46 extending the full length along the rail side. A cross slat is indicated at 48. A diagonal brace 50 is assembled with one mitered end in rabbet 42 and the mitered other end 51 disposed under an end of slat 48 in abutting relation to the inner face of rail 44. The ends of slat 48 extend into and across the rabbets 46. All parts are suitably fastened by the use of nails or other devices, a typical nailing pattern being disclosed in FIGS. 7 and 8.

Each side rail 44 is transversely rabbetted at each end to provide a lip or end flange 54 that fits into the rabbet 42. It will be noted that an end of each of the side rails, as shown in FIG. 6, is square and uncurved. It should be compared with the machine and manually-curved side rail 10 of FIG. 3. Side rails 44 of this invention are devoid of any arcuate cuts at their ends. The ends of the head rails 40 are, however, cut arcuately as at 56 in such manner that the curved cut terminates in line with, and preferably tangential with, the outer edge of side rail 44. In other words, the curved cut 56 is restricted to between the outer edge of the non-rabbetted portion of the head rail 40 and its end, terminating approximately tangential with the flange 58 remaining after rabbet 42 is cut in the timber. Flange 58 is disposed in rabbet 54 when the frame is assembled.

To comprehend this properly, reference characters X, Y and Z have been applied to FIG. 5 at the curved end of head rail 40. X represents the full unrabbetted width of the end rail. Y represents that portion of the end rail, i.e., flange 58, that is not curved or cut arcuately. Z represents that portion of the end rail which is arcuately curved at 56. A typical end rail has a basic width (X) of $3\frac{1}{4}$ inches. The depth of rabbet 42 and the width of flange 58 (Y) is typically $1\frac{1}{8}$ inches, that is, one-half the rail thickness. The non-rabbetted portion Z of the end rail, in which the curve 56 is cut, is therefore $2\frac{1}{8}$ inches.

From the foregoing it will be seen that in the manufacture of the new round-nose frame as in FIG. 1, the side rails 44 are all produced in a straightforward manner employing conventional woodworking machinery requiring minimal manual attention, probably only with respect to feeding the apparatus and off-bearing the machined wooden pieces to provide the longitudinal linear rabbet 46 and the transverse rabbet 54. The end or head rails 40 are also linearly machined in conventional manner to provide the rabbet 42 and flange 58. The only manhandling required of them is to apply the curved ends 56 at each end.

A particular advantage arises when the knocked-down parts are being assembled to provide the rigid and round-cornered frame needed by the bedding furniture manufacturer. Because the curve 56 is restricted to a non-rabbetted portion Z of each end rail 40, that portion of the rail represented by the reference Y, i.e., the end of flange 58, is at right angles to the length of the end rail, and when fitted in a square manner with the side rail, lines up truly and smoothly.

Throughout the drawings for convenience of illustration, the various parts are shown assembled in slightly spaced-apart relationship. It will be understood, of course, that in the finished product, particularly where the parts are assembled in a clamping device and then securely nailed together, the ends of all the slats 48 abut the non-rabbetted portions 45 of side rails 46, and the end of a side rail tightly interfits with the linear rabbet at the end of rail 40. In similar manner, the diagonal cross braces 50, 50 likewise are brought into close juxtaposition bearing upon the relative parts of the frame, and tightly fastened.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the legitimate and valid scope of the appended claims, appropriately interpreted in accordance with the doctrine of equivalents.

What is claimed is:

1. A round-nosed corner joint for a wooden bedding furniture frame in which two wooden structural members are jointed at right angles, comprising:

a first elongated member 40 having a non-rabbetted longitudinal portion and an inside edge rabbet 42 extending contiguously parallel along said non-rabbetted portion from the joint end of said member;

said edge rabbett 42 providing an edge flange 58 having a thickness which is substantially one-half the thickness of said first member 40, the width of said flange being approximately one-third the width of said first member 40, and one face of said flange being coplanar with a face of said non-rabbetted portion;

said first member 40 having an accurately rounded joint end, the curvature 56 of which is restricted to between and coextensive with the outer edge and the end of the non-rabbetted portion of said first member 40; one end of said curvature merging tangentially with the adjacent end of said flange 58;

a second member 44 of a thickness equal to said first member 40, and having a transverse rabbet 54 at its end forming a flange of a width and thickness to fit into said edge rabbet and, in coplanar manner, interfitting said first and second members; and means fixedly securing said members in their interfitted relation.

2. The method of providing a round nose on a stopped half-lapped joint at a corner of a rectangular wooden box spring frame or the like, comprising:

establishing an axis of rotation fixed relative a cutting tool;

disposing an end of a cross member so that said axis passes perpendicularly through said cross member at a location spaced a predetermined distance inward from said cross member end and also spaced inward between the side edges of said cross member a like distance from the outside edge when said outside edge is tangential to said cutting tool; and obtaining relative movement between said cross member and cutting tool about said axis whereby said cross member is provided with a convexly curved corner that is tangential to both the end of the cross member and to said outer edge.

* * * * *